United States Patent [19]

Cheng

[11] Patent Number: 4,773,649

[45] Date of Patent: Sep. 27, 1988

[54] PIECES ASSEMBLABLE TO FORM REGULAR HEXAGONS AND OTHER FIGURES

[75] Inventor: Sen-Der Cheng, Taichung, Taiwan

[73] Assignee: Tien-Tsai Huang, Panchiao, Taiwan

[21] Appl. No.: 48,851

[22] Filed: May 12, 1987

[51] Int. Cl.[4] ..... A63F 9/10

[52] U.S. Cl. ..... 273/157 R

[58] Field of Search ..... 273/157 R

[56] References Cited

U.S. PATENT DOCUMENTS

| | | | |
|---|---|---|---|
| 3,178,186 | 4/1965 | Lee | 273/157 R |
| 3,637,217 | 1/1972 | Kent | 273/157 R |
| 4,343,471 | 12/1982 | Calvert | 273/157 R |
| 4,561,097 | 12/1985 | Siegel | 273/157 R |

*Primary Examiner*—Anton O. Oechsle

*Attorney, Agent, or Firm*—Townsend & Townsend

[57] ABSTRACT

A set of movable pieces for board game include a pair of similar triangular pieces, a pair of similar pentagonal pieces, a pair of similar rhomboidal pieces, a pair of similar trapezoidal pieces, and a rhombic piece. The set of movable pieces can be assembled side by side to form a regular hexagon which can be divided into three similar rhombi each assembled by three of the set of movable pieces. The regular hexagon can be assembled from the set of movable pieces in different manners. In addition to the regular hexagon, the set of movable pieces can also be assembled to form many other figures like the outlines of animals or natural phenomena.

32 Claims, 6 Drawing Sheets

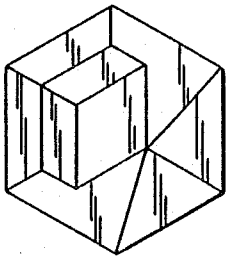
FIG. 3a
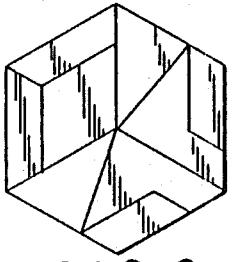
FIG. 3b
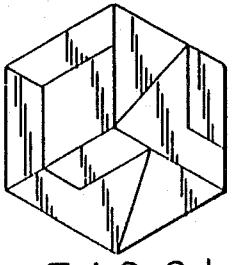
FIG. 3c
FIG. 3d
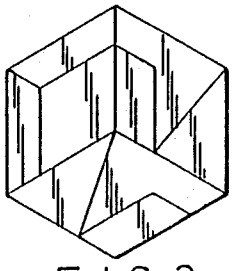
FIG. 3e
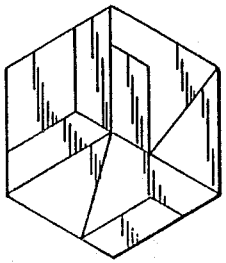
FIG. 3f
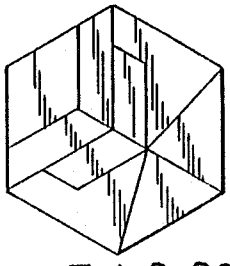
FIG. 3g
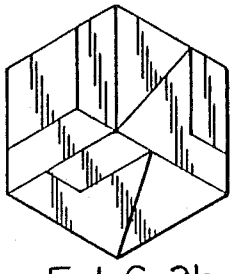
FIG. 3h
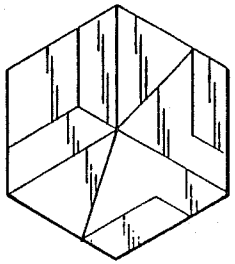
FIG. 3i

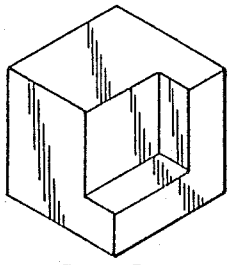
FIG. 7a
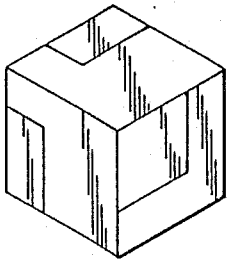
FIG. 7b
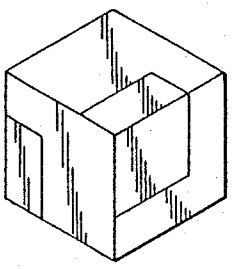
FIG. 7c
FIG. 7d
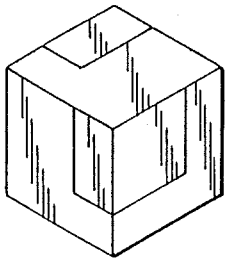
FIG. 7e
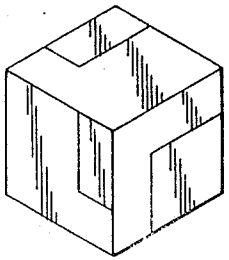
FIG. 7f
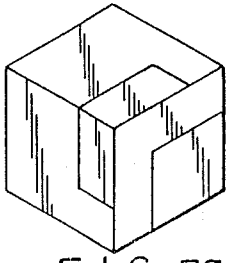
FIG. 7g
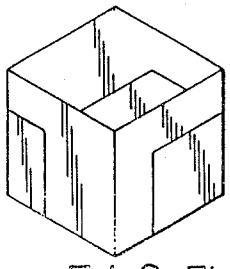
FIG. 7h
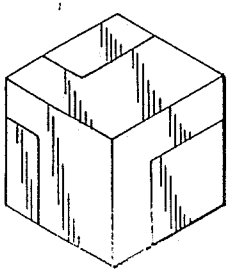
FIG. 7i

PIECES ASSEMBABLE TO FORM REGULAR HEXAGONS AND OTHER FIGURES

BACKGROUND OF THE PRESENT INVENTION

The present invention relates to a board game, and more particularly to a set of movable pieces which can be assembled in different manners to form many figures like the outlines of animals or natural phenomena, especially like an equilangular perspective view which has a three-dimensional effect.

Generally, for conventional board games, only a resultant drawing can be assembled by several movable pieces in a board in an exclusive manner. Consequently, because this type of board game quickly becomes monotonous, it fails to amuse players for extended periods of time. Furthermore, educational benefits are not enhanced because conventional board game does not stimulate the player's creativity.

SUMMARY OF THE INVENTION

It is therefore an object of the present invention to provide a set of movable pieces for board game which can be assembled in different manners to form many figures like the outlines of animals or natural phenomena, especially like an equilangular perspective view which has a three-dimensional effect.

According to the present invention, the set of movable pieces for board game includes a pair of triangular pieces, a pair of pentagonal pieces, a pair of rhomboidal pieces, a pair of trapezoidal pieces, and a rhombic piece. The set of movable pieces can be assembled side by side to form three similar rhombi which in turn can be assembled side by side in different manners to form a regular hexagon which appears to be an equilangular perspective view having three-dimension effect. In addition to the regular hexagon, the set of movable pieces can also be assembled to form other figures like the outlines of animals or natural phenomena.

BRIEF DESCRIPTION OF THE DRAWINGS

Other features and advantages of the present invention will become apparent from the following detailed description of the preferred embodiments of the present invention with reference to the accompanying drawings in which:

FIGS. 3*a* to 3*i* illustrate the regular hexagonal assemblies of the set of movable pieces of FIG. 1;

FIGS. 7*a* to 7*i* illustrate the regular hexagonal assemblies of the set of movable pieces of FIG. 5.

DETAILED DESCRIPTION OF THE PREFERRED EMBODIMENTS

Figure 1:
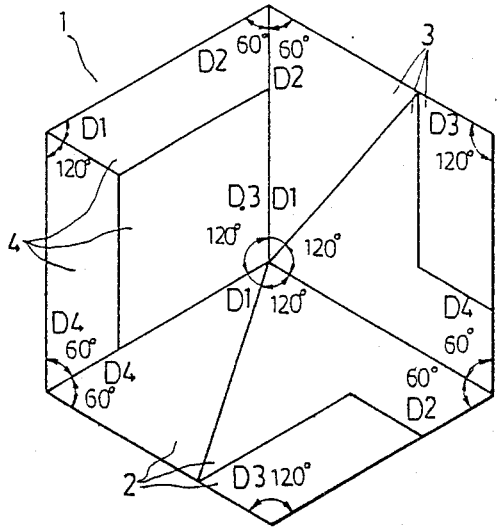
FIG. 1 is an elevational view showing the assembly of a set of movable pieces for board game according to a preferred embodiment of the present invention.
Figure 2:
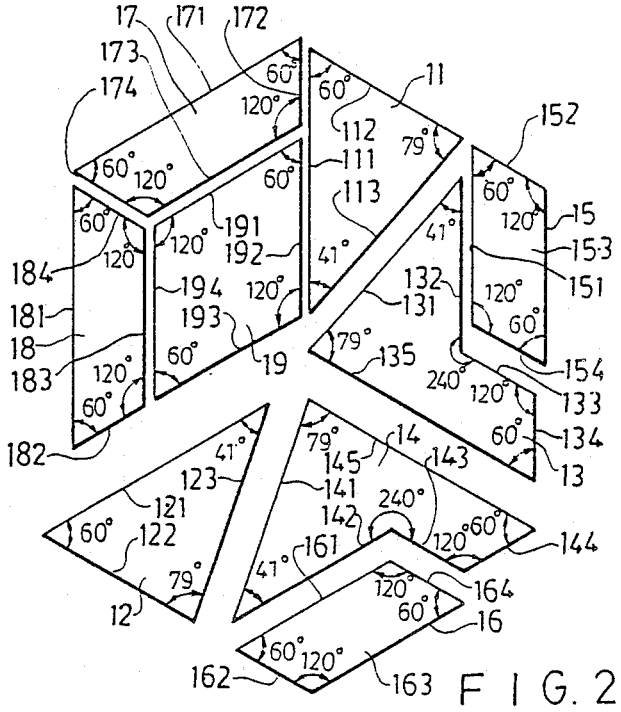
FIG. 2 is an exploded view showing the set of movable pieces of FIG. 1.
Figure 4A:
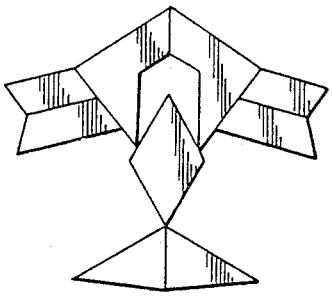
FIGS. 4*a* to 4*j* illustrate the irregular shaped assemblies of the set of movable pieces of FIG. 1.
Figure 4B:
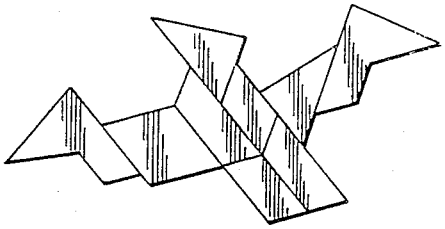
Figure 4C:
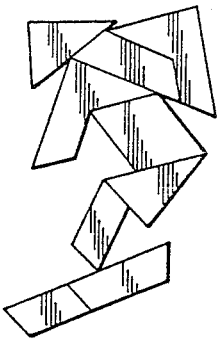
Figure 4D:
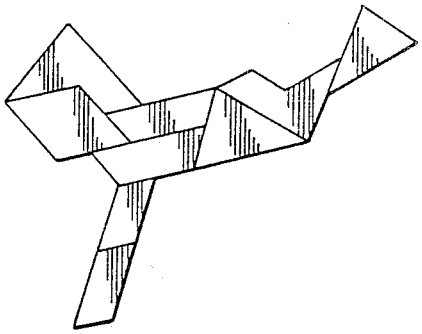
Figure 4E:
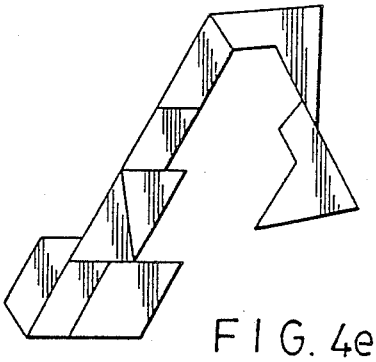
Figure 4F:
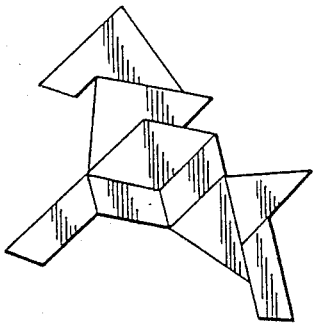
Figure 4G:
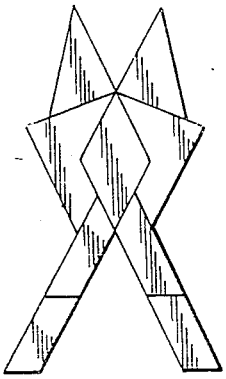
Figure 4H:
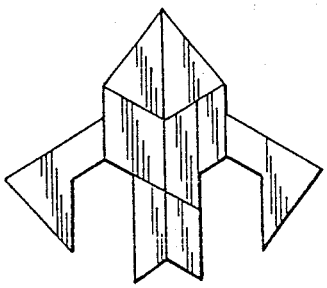
Figure 4I:
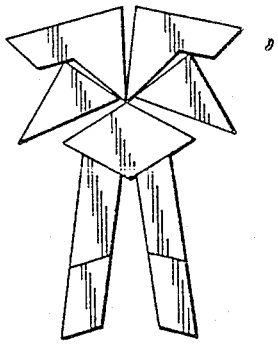
Figure 4J:
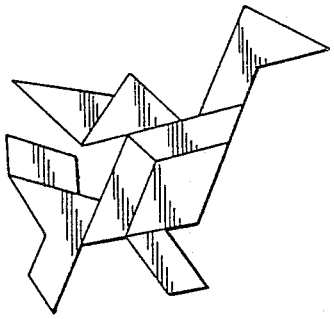

Referring to FIG. 1 with reference to FIG. 2, there is shown a set of movable planar pieces for board game according to the present invention. The set of movable plan pieces are assembled side by side to form a regular hexagon 1 which is divided into three similar rhombi 2, 3 and 4 each assembled from three movable pieces. Each of the rhombi 2, 3 and 4 has four interior angles D1, D2, D3, and D4. Each of the interior angles D1 and D3 has an angle of 120 degrees. And, each of the interior angles D2 and D4 has an angle of 60 degrees.

Referring to FIG. 2, the set of movable pieces includes a pair of triangular pieces 11 and 12, a pair of pentagonal pieces 13 and 14, a pair of rhomboidal pieces 15 and 16, a pair of trapezoidal pieces 17 and 18, and a rhombic piece 19.

Each of the triangular pieces 11 and 12 has first side 111, 121, second side 112, 122, and third side 113, 123. The first and second sides define an interior angle of 60 degrees. The second and third sides define an interior angle of 79 degrees. The first and third sides define an interior angle of 41 degrees. Each of the first sides forms one side of the rhombi.

Each of the pentagonal pieces 13 and 14 has first side 131, 141, second side 132, 142, third side 133, 143, fourth side 134, 144, and fifth side 135, 145. The first and second sides of each of the pentagonal pieces define an interior angle of 41 degrees. The second and third sides of each of the pentagonal pieces define an interior angle of 240 degrees. The third and fourth sides of each of the pentagonal pieces define an interior angle of 120 degrees. Th fourth and fifth sides of each of the pentagonal pieces define an interior angle of 60 degrees. The first and fifth sides of each of the pentagonal pieces define an interior angle of 79 degrees. The first sides of the pentagonal pieces are of a length the same as that of the third sides of the triangular pieces. Each of the fifth sides forms one side of the rhombi.

Each of the rhomboidal pieces has first side 151, 161, second side 152, 162, third side 153, 163, and fourth side 154, 164. The first and third sides of the rhomboidal pieces are the long sides thereof. And, the second and fourth sides of the rhomboidal pieces are the short sides thereof. The first and second sides of each of the rhomboidal pieces define an interior angle of 60 degrees. The second and third sides of each of the rhomboidal pieces define an interior angle of 120 degrees. The third and fourth sides of each of the rhomboidal pieces define an interior angle of 60 degrees. The first and fourth sides of each of the rhomboidal pieces define an interior angle of 120 degrees. The long sides of the rhomboidal pieces are of a length the same of that of the second sides of the pentagonal pieces. And, the short sides of the rhomboidal pieces are of a length the same of that of the third sides of the pentagonal pieces. The length of the long sides of the rhomboidal pieces plus the length of the fourth sides of the pentagonal pieces is equal to that of the sides of the rhombi.

Each of the trapezoidal pieces 17 and 18 has first side 171, 181, second side 172, 182, third side 173, 183, and fourth side 174, 184. The first and third sides of each of the trapezoidal pieces are parallel to each other. The first and second sides of each of the trapezoidal pieces define an interior angle of 60 degrees. The second and third sides of each of the trapezoidal pieces define an interior angle of 120 degrees. The third and fourth sides of each of the trapezoidal pieces define an interior angle of 120 degrees. The first and fourth sides of each of the trapezoidal pieces define an interior angle of 60 degrees. Each of the first sides of the trapezoidal pieces forms one side of the rhombi. The third sides of the trapezoidal pieces are of a length the same as that of the long sides of the rhomboidal pieces. The second and fourth sides of the trapezoidal pieces are of a length the same as that of the short sides of the rhomboidal pieces.

The rhombic piece 19 has first side 191, second side 192, third side 193, and fourth side 194. The first and second sides of the rhombic piece define an interior angle of 60 degrees. The second and third sides of the rhombic piece define an interior angle of 120 degrees. The third and fourth sides of the rhombic piece define an interior angle of 60 degrees. The first and fourth sides of the rhombic piece define an interior angle of 120 degrees. Each of the sides of the rhombic piece is of a length the same as that of the third sides of the trapezoidal pieces. The length of the sides of the rhombic piece plus the length of the second and fourth sides of the trapezoidal pieces is equal to that of the sides of the rhombi.

By assembling the set of movable pieces, the regular hexagons as shown in FIGS. 3*a* to 3*i* can be obtained. Alternatively, the irregular shaped assemblies as shown in FIGS. 4*a* to 4*j* can be obtained. It should be explained that the assembly is an imitiation of an airplane in FIG. 4*a*, an eagle in FIG. 4*b*, a skater in motion in FIG. 4*c*, a diving swimmer in FIG. 4*d*, an excavator in FIG. 4*e*, a jumping horse in FIG. 4*f*, a nipper in FIG. 4*g*, a rocket in FIG. 4*h*, a kite in FIG. 4*i*, and a duck in FIG. 4*k*. These shapes can be facilitated to promote the player's creativity and pleasure.

Figure 5:
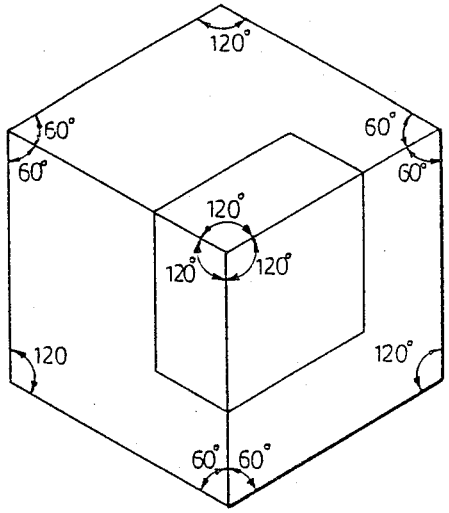
FIG. 5 is an elevational view showing the assembly of another set of movable pieces for board game according to the alternative embodiment of the present invention.
Figure 6:
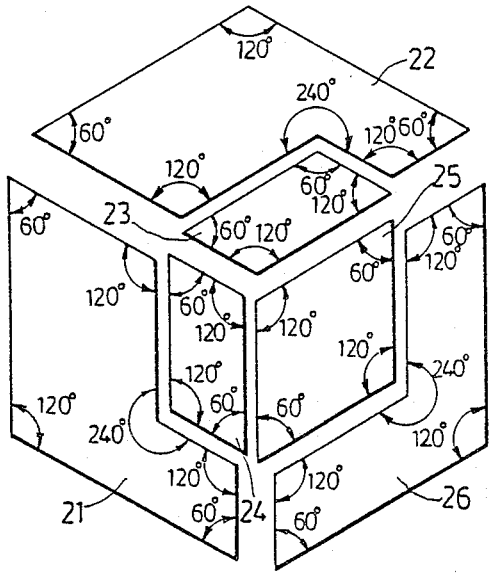
FIG. 6 is an exploded view showing the set of movable pieces of FIG. 5.

If the players are too young to realize the above assemblies, another set of movable pieces as shown in FIGS. 5 and 6 might be suitable for them. This set of movable pieces includes a pair of similar oblique L-shaped pieces 21 and 22, a pair of similar rhomboidal pieces 23 and 24, a rhombic piece 25, and a V-shaped piece 26. By contrasting FIG. 1 with FIG. 6, it can be analyzed that one of the pentagonal pieces 13 and 14 may be incorporated with one of the triangular pieces 11 and 12 to form one of the oblique L-shaped pieces 21 and 22, and the trapezoidal pieces 17 and 18 can be incorporated into the V-shaped piece 26.

Similarly, the simplified regular hexagonal assemblies as shown in FIGS. 7*a* to 7*i* can be obtained from the set of six separate pieces. At first sight, each of the nine regular hexagonal assembly appears to be an equilangular perspective view which thus has a three-dimensional effect.

As explained in the foregoing, the multiple variety of shapes formed by the movable pieces of the present invention are novel and very interesting. The above object of the present invention can thus be achieved.

With the present invention thus explained, it is apparent that various modifications and variations can be made without departing from the scope and spirit of the present invention. It is therefore intended that the present invention be limited only as indicated in the appended claims.

What is claimed is:

1. A set of movable pieces for board game consisting of nine movable pieces which are capable of being assembled side by side to form three similar large rhombi which are capable of being assembled side by side to form a regular hexagon, said movable pieces comprising:

a pair of triangular pieces each having a first side, second side, and third side, said first and second sides defining an interior angle of about 60 degrees, said second and third sides defining an interior angle of about 79 degrees, said first and third sides defining an interior angle of about 41 degrees, each of said first sides forming one of the sides of said large rhombi;

a pair of pentagonal pieces each having a first side, second side, third side, fourth side, and fifth side, said first and second sides of each of said pentagonal pieces defining an interior angle of about 41 degrees, said second and third sides of each of said pentagonal pieces defining an interior angle of about 240 degrees, said third and fourth sides of each of said pentagonal pieces defining an interior angle of about 120 degrees, said fourth and fifth sides of each of said pentagonal pieces defining an interior angle of about 60 degrees, said first and fifth sides of each of said pentagonal pieces defining an interior angle of about 79 degrees, said first sides of said pentagonal pieces being of a length the same as that of said third sides of said triangular pieces, each of said fifth sides forming one of the sides of said large rhombi;

a pair of rhomboidal pieces each having a first side, second side, third side, and fourth side, said first and third sides of said rhomboidal pieces being the long sides thereof, said second and fourth sides of said rhomboidal pieces being the short sides thereof, said first and second sides of each of said rhomboidal pieces defining an interior angle of about 60 degrees, said second and third sides of each of said rhomboidal pieces defining an interior angle of about 120 degrees, said third and fourth sides of each of said rhomboidal pieces defining an interior angle of about 60 degrees, said first and fourth sides of each of said rhomboidal pieces defining an interior angle of about 120 degrees, the long sides of said rhomboidal pieces being of a length the same of that of said second sides of said pentagonal pieces, the short sides of said rhomboidal pieces being of a length the same of that of said third sides of said pentagonal pieces, the length of the long sides of said rhomboidal pieces plus the length of said fourth sides of said pentagonal pieces being equal to that of the sides of said large rhombi;

a pair of trapezoidal pieces each having a first side, second side, third side, and fourth side, said first and third sides of each of said trapezoidal pieces being parallel to each other, said first and second sides of each of said trapezoidal pieces defining an interior angle of about 60 degrees, said second and third sides of each of said trapezoidal pieces defining an interior angle of about 120 degrees, said third and fourth sides of each of said trapezoidal pieces defining an interior angle of about 120 degrees, siad first and fourth sides of each of said trapezoidal pieces defining an interior angle of about 60 degrees, each of said first sides of said trapezoidal pieces forming one of the sides of said large rhombi, said third sides of said trapezoidal pieces being of a length the same as that of the long sides of said rhomboidal pieces, said second and fourth sides of said trapezoidal pieces being of a length the same as that of the short sides of said rhomboidal pieces; and a small rhombic piece having a first side, second side, third side, and fourth side, said first and second sides of said small rhombic piece defining an interior angle of about 60 degrees, said second and third sides of said small rhombic piece defining an interior angle of about 120 degrees, said third and fourth sides of said small rhombic piece defining an interior angle of about 60 degrees, said first and fourth sides of said small rhombic piece defining an interior angle of about 120 degrees, each of said sides of said small rhombic piece being of a length the same as that of said third sides of said trapezoidal pieces, the lenght of said sides of said small rhombic piece plus the length of said second and fourth sides of said trapezoidal pieces being equal to that of the sides of said large rhombi;

whereby, the set of said movable pieces can be assembled in different manners so as to form many figures like the outlines of animals or natural phenomena in addition to the regular hexagon.

2. A set of movable pieces for a board game consisting of six movable pieces which are capable of being assembled side by side to form different patterns, including nine regular hexagonals, said movable pieces comprising:

a pair of oblique L-shaped pieces, each said piece formed by connecting securely together a third side of a triangular piece with a first side of a pentagonal piece;

each said triangular piece having a first side, second side, and third side, said first and second sides defining an interior angle of about 60 degrees, said second and third sides defining an interior angle of about 79 degrees, said first and third sides defining an interior angle of about 41 degrees, and each said pentagonal piece having a first side, second side, third side, fourth side, and fifth side, said first and second sides of each of said pentagonal piece defining an interior angle of about 41 degrees, said second and third sides of each of said pentagonal piece defining an interior angle of about 240 degrees, said third and fourth sides of each of said pentagonal piece defining an interior angle of about 120 degrees, said fourth and fifth sides of each of said pentagonal piece defining an interior angle of about 60 degrees, said first and fifth sides of each of said pentagonal piece defining an interior angle of about 79 degrees, said first sides of said pentagonal pieces being of a length the same as that of said third sides of said triangular pieces;

a pair of rhomboidal pieces each having first side, second side, third side, and fourth side, said first and third sides of said rhomboidal pieces being the long sides thereof, said second and fourth sides of said rhomboidal pieces being the short sides thereof, said first and second sides of each of said rhomboidal pieces defining an interior angle of about 60 degrees, said second and third sides of each of said rhomboidal pieces defining an interior angle of about 120 degrees, said third and fourth sides of each of said rhomboidal pieces defining an interior angle of about 60 degrees, said first and fourth sides of each of said rhomboidal pieces defining an interior angle of about 120 degrees, the long sides of said rhomboidal pieces being of a length the same of that of said second sides of said pentagonal pieces, the short sides of said rhomboidal pieces being of a length the same of that of said third sides of said pentagonal pieces;

a V-shaped piece formed by connecting securely together either a second or fourth side of two trapezoidal pieces, each trapezoidal piece having a first side, second side, third side, and fourth side, said first and third sides of said trapezoidal pieces being parallel to each other, said first and second sides of each of said trapezoidal pieces defining an interior angle of about 60 degrees, said second and third sides of each of said trapezoidal piece defining an interior angle of about 120 degrees, said third and fourth sides of each of said trapezoidal pieces defining an interior angle of about 120 degrees, said first and fourth sides of each of said trapezoidal pieces defining an interior angle of about 60 degrees, said second and fourth sides of said trapezoidal pieces being a length the same as that of the short sides of said rhomboidal pieces; and a small rhombic piece having first side, second side, third side, and fourth side, said first and second sides of said small rhombic piece defining an interior angle of about 60 degrees, said second and third sides of said small rhombic piece defining an interior angle of about 120 degrees, said third and fourth sides of said small rhombic piece defining an interior angle of about 60 degrees, said first and fourth sides of said small rhombic piece defining an interior angle of about 120 degrees, each of said sides of said small rhombic piece being of a length the same as that of said third sides of said trapezoidal pieces;

whereby, the set of said movable pieces can be assembled in different arrangements to form a number of regular hexagons, which appear to be an equiangular perspective view, thus having a three-dimensional effect.

* * * * *